US005370550A

United States Patent [19]

Alwine et al.

[11] Patent Number: 5,370,550

[45] Date of Patent: Dec. 6, 1994

[54] LOCKING CONNECTOR EXHIBITING AUDIO-TACTILE DIDACTICISM

[75] Inventors: K. Troy Alwine, Warren; Bradley G. Johnson, Russell, both of Pa.; Gregory R. Pratt, Woodridge, Ill.; Douglas G. Seymour, Warren, Pa.

[73] Assignee: OSRAM Sylvania Inc., Danvers, Mass.

[21] Appl. No.: 166,127

[22] Filed: Dec. 13, 1993

[51] Int. Cl.[5] ..... H01R 13/627

[52] U.S. Cl. ..... 439/352; 439/357

[58] Field of Search ..... 439/350, 351, 352, 353, 439/354, 355–358, 489, 488

[56] References Cited

U.S. PATENT DOCUMENTS

| | | | |
|---|---|---|---|
| 4,370,013 | 1/1983 | Niitsu et al. | 339/82 |
| 4,634,204 | 11/1987 | Detter et al. | 439/352 |
| 4,655,527 | 4/1987 | Vandame | 339/91 R |
| 4,746,306 | 5/1988 | Yurtin et al. | 439/352 |
| 4,892,490 | 1/1990 | Tsuchiya et al. | 439/489 |
| 4,938,710 | 7/1990 | Aihara et al. | 439/345 |
| 4,946,404 | 8/1990 | Takenouchi et al. | 439/352 |
| 4,959,023 | 9/1990 | Watanabe et al. | 439/595 |
| 5,015,199 | 5/1991 | Hirano et al. | 439/353 |
| 5,120,255 | 6/1992 | Kouda et al. | 439/489 |
| 5,257,944 | 11/1993 | Kennedy | 439/347 |
| 5,292,258 | 3/1994 | Sakurai | 439/352 |

FOREIGN PATENT DOCUMENTS

| | | | |
|---|---|---|---|
| 1163085 | 9/1969 | United Kingdom | 439/367 |

*Primary Examiner*—Larry I. Schwartz
*Assistant Examiner*—Hien D. Vu
*Attorney, Agent, or Firm*—William H. McNeill

[57] ABSTRACT

A connector, for example an electrical connector, comprises first and second slidably engaging portions (12) (14) having a lock (16) distributed therebetween. The lock (16) comprises a locking tongue (18) having a fixed end (20) attached to the first portion, and a free end (22) extending therefrom. First and second spaced apart side walls (28, 30) are positioned adjacent the free end. A keeper (24) is formed on the second portion, and has a roof (31 ) and first and second spaced apart side walls (34, 36), and a depending lug (38) on the interior of the keeper roof. The free end (22) of the tongue (18) is formed to engage the lug (38) on the keeper roof. A lock disabler (26) having two operative positions with respect to the locking tongue is provided. A first position allows disengagement of the free end of the locking tongue from the keeper and a second position prevents disengagement of the free end of said locking tongue from the keeper.

2 Claims, 6 Drawing Sheets

LOCKING CONNECTOR EXHIBITING AUDIO-TACTILE DIDACTICISM

TECHNICAL FIELD

This invention relates to locking members and more particularly, to locking connectors. Still more particularly, the invention relates to locking members for electrical connectors.

BACKGROUND ART

It is occasionally desired, particularly in the field of electrical connectors, to provide a positive structure for maintaining the parts of a connector in a mated condition. One prevalent method has involved the use of threaded bolts and nuts fitted through an appropriate section of the connectors. Other systems have relied on friction fit to hold the connector parts together; and others have employed various forms of locking tongues such as those shown in U.S. Pat. Nos. 5,015,199; 4,959,023; 4,938,710; 4,655,527; 4,370,013; and British Pat. No. 1,163,085.

While all of the prior art systems have provided some advantages, there are problems with many of them in certain instances. For example, while the bolt and nut approach is very secure, it is very time consuming and can be awkward if space is limited, such as in the engine compartment of an automobile. Under similar circumstances it would also be possible for friction-fit connectors to vibrate loose and, in the case of locking tongue connectors, it is sometimes difficult to tell when they are properly seated. Also, they are subject to unwanted disconnection in the event an operator inadvertently depresses the locking tongue.

DISCLOSURE OF THE INVENTION

It is, therefore, an object of the invention to obviate the disadvantages of the prior art.

It is another object of the invention to enhance the reliability of lockable connectors.

Yet another object of the invention is the provision of a lockable connector that provides audio-tactile feedback to an operator to inform the operator of the completion of the connection.

These objects are accomplished, in one aspect of the invention, by the provision of a connector which comprises first and second slidably engaging portions with a lock distributed therebetween. The lock comprises a locking tongue having a fixed end attached to the first portion and a free end extending therefrom and a keeper on the second portion, the free end being formed to engage the keeper. A lock disabler is operatively positioned with the locking tongue and actuable when the free end of the locking tongue and the keeper are engaged.

Connectors employing this lock are inexpensive to produce and easy to use. Additionally, the use of the lock disabler makes it virtually impossible to unintentionally deactivate the lock.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
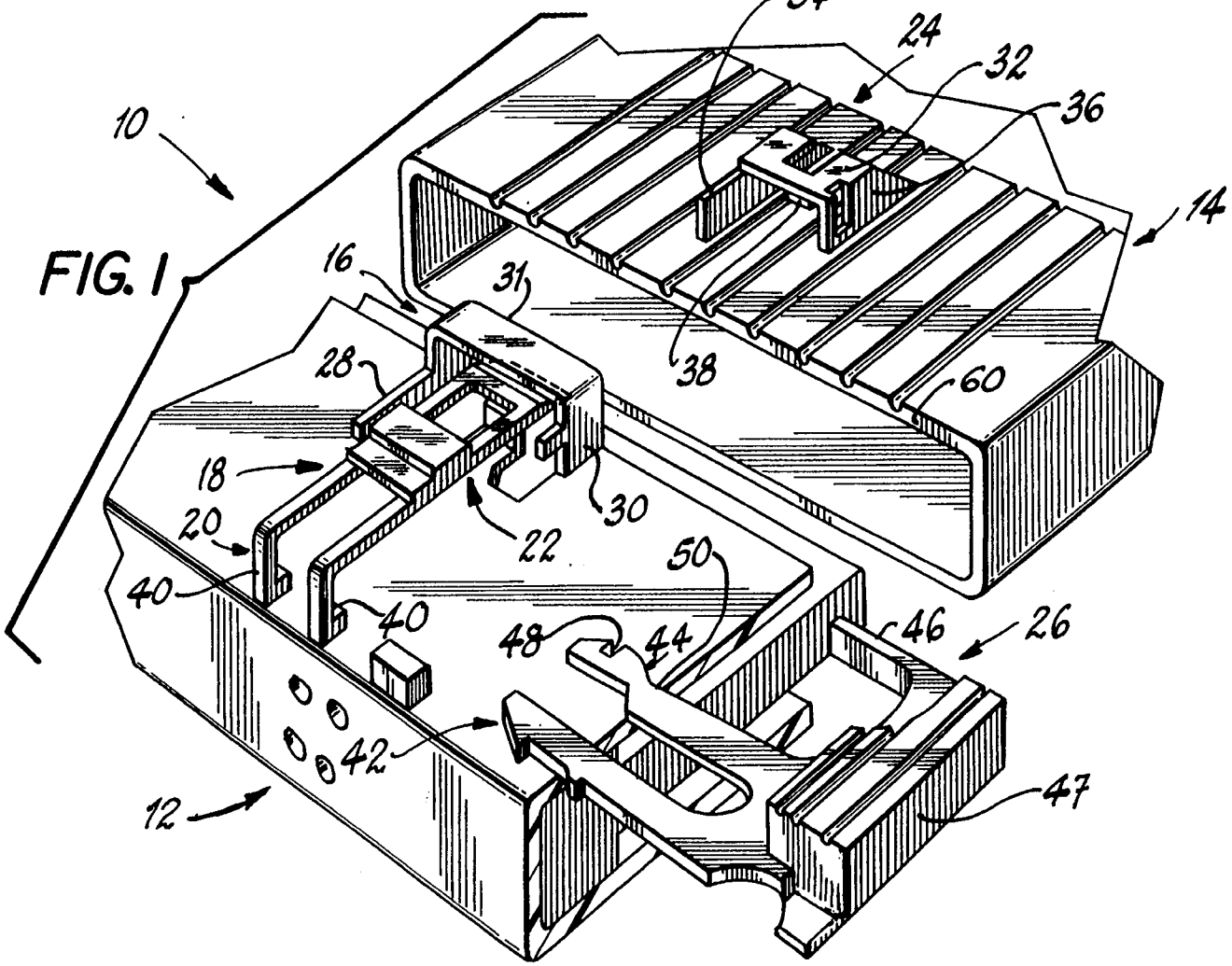
FIG. 1 is an exploded, perspective view of a connector using an embodiment of the invention.

Referring now to the drawings with greater particularity, there is shown in FIG. 1 a connector 10 comprised of a first portion 12 and a second portion 14 which are slidably engageable. A lock 16 is distributed between portions 12 and 14 and comprises a locking tongue 18 which has a fixed end 20 on the first portion 12 and a free end 22 which extends from the fixed end 20. A keeper 24 is formed on the second portion 14 and the free end 22 is formed to engage the keeper. A lock disabler 26 is operatively positioned with the locking tongue 18 and is actuable, under normal conditions, only when the free end 22 of tongue 18 is engaged with the keeper 24, as will be explained more fully hereinafter.

First and second walls 28 and 30, respectively, are located adjacent the free end 18 and may be connected by a roof 31. The keeper 24 has a roof 32 which is supported by a first keeper wall 34 and a second keeper wall 36. A lug 38 depends from the roof 32 of keeper 24 and forms the part which engages the free end 22 of tongue 18.

Figure 3A:
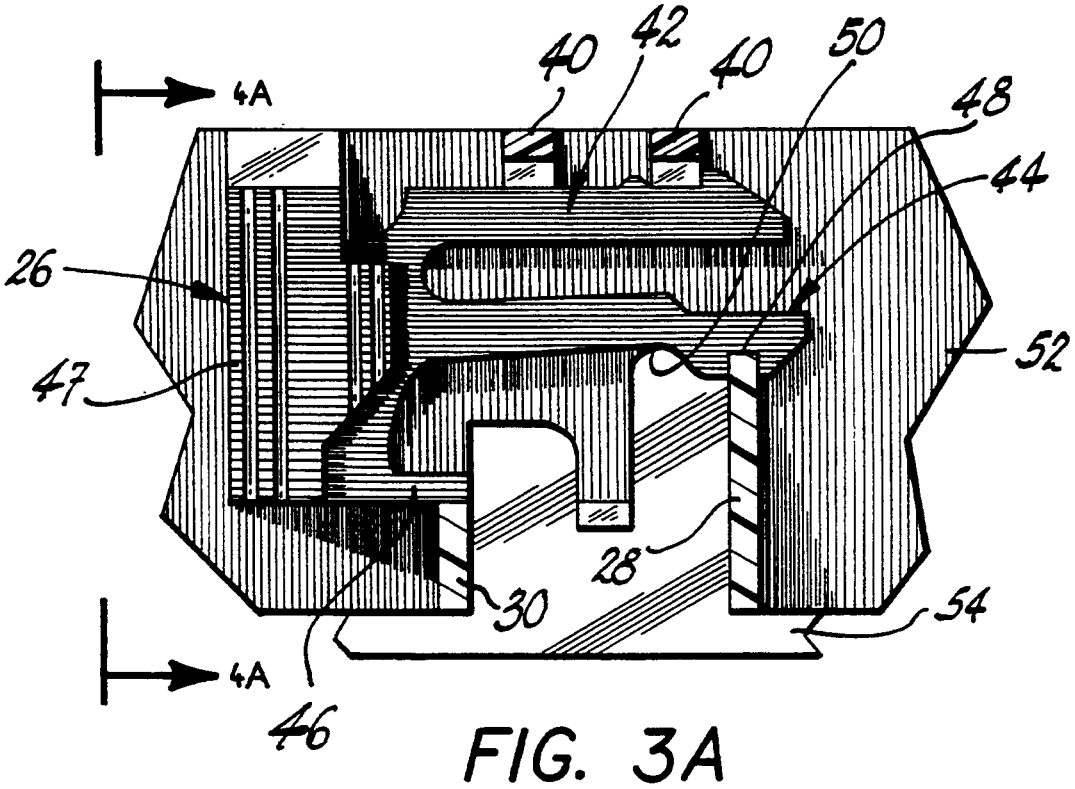
FIGS. 3A–3C are similar views illustrating a sequence of operations in the mating of two connector halves.
Figure 5:
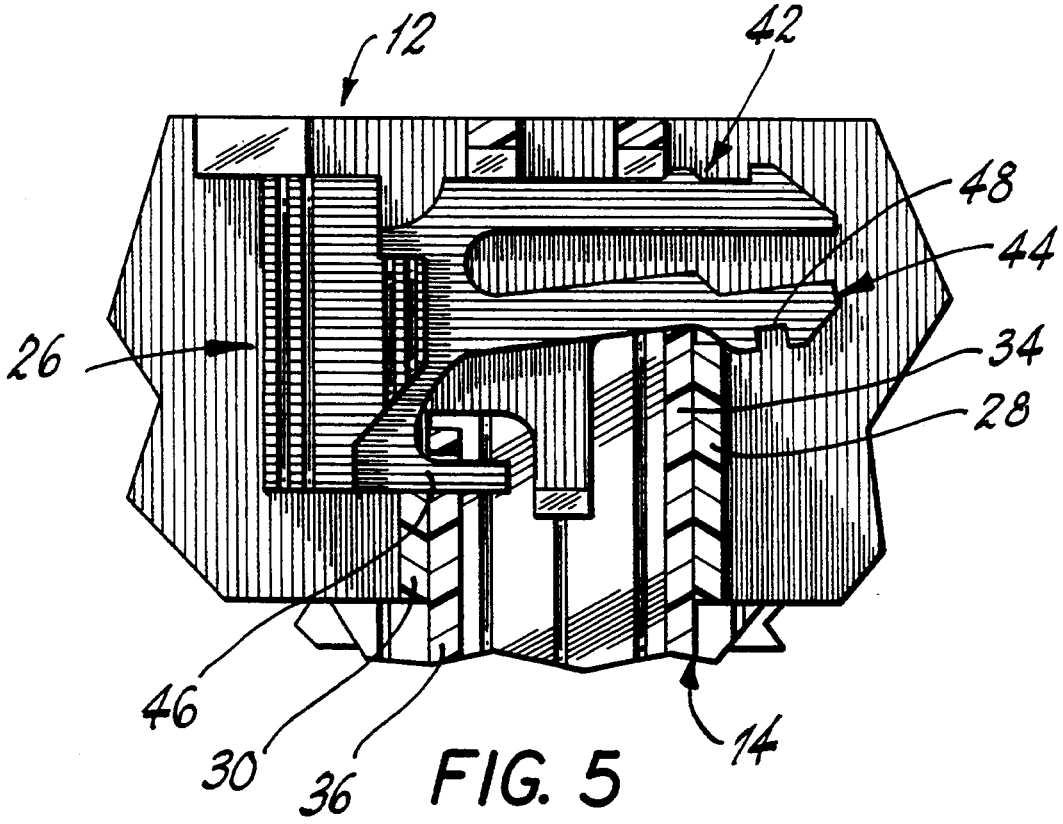
FIG. 5 is a plan view, partially in section, illustrating the consummated connection with the lock disabler in place.

The lock disabler 26 has two operative positions with respect to the locking tongue 18, a first position which allows disengagement of the free end 22 of locking tongue 18 from the keeper 24, shown in FIG. 3A, and a second position which prevents disengagement of the free end of the locking tongue 18 from the keeper, as shown in FIG. 5.

Referring now to FIG. 3A, the fixed end 20 of tongue 18 includes upstanding legs 40, (shown in section in FIG. 3A) and the lock disabler 26 includes a primary leg 42, a secondary leg 44, and a locking tongue disabler extension 46, all attached to and extending from a body 47. The primary leg 42 engages the upstanding legs 40 and the secondary leg is provided with a first area 48, which can be a slot, which engages the first wall 28. When this latter engagement is present, it prevents the lock disabler from moving into the second position. The locking tongue disabler extension 46 is in guiding relation with the second wall 30. The lock disabler 26 has a second area 50 formed with the secondary leg 44 which, when the lock disabler 26 is in its second position, will be in contact with the first wall 34 of the keeper 24.

Figure 2:
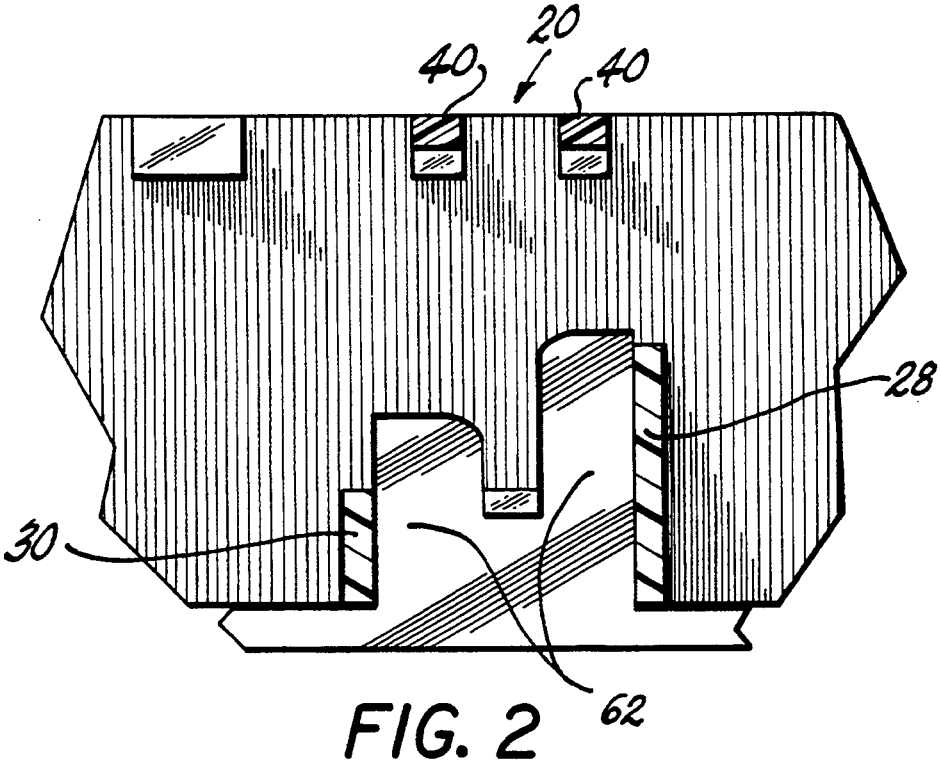
FIG. 2 is a plan view, partially in section, of a first portion of a connector.

Referring particularly to FIGS. 3A–4C the sequence of locking actions is illustrated. In FIGS. 3A and 4A, first portion 12 of connector 10, which may be an electrical connector, comprises a body 52 which is parallelepipedonal and has an internal structure 54 smaller in extent, thereby leaving a receiving aperture 56 thereabout. Second portion 14 has a substantially hollow parallelepipedonal body 58 which has a peripheral lip 60 which telescopes into aperture 56. Lock disabler 26 is in its first position with primary leg 42 in contact with legs 40 and secondary leg 44 having its first area 48 in engagement with first wall 28. The locking tongue disabler extension 46 is positioned against second wall 30. A cut-out 62 (see FIG. 2) is provided in the top surface of first portion 12, between the walls 28 and 30, for receiving the keeper walls 34 and 36.

Figure 3B:
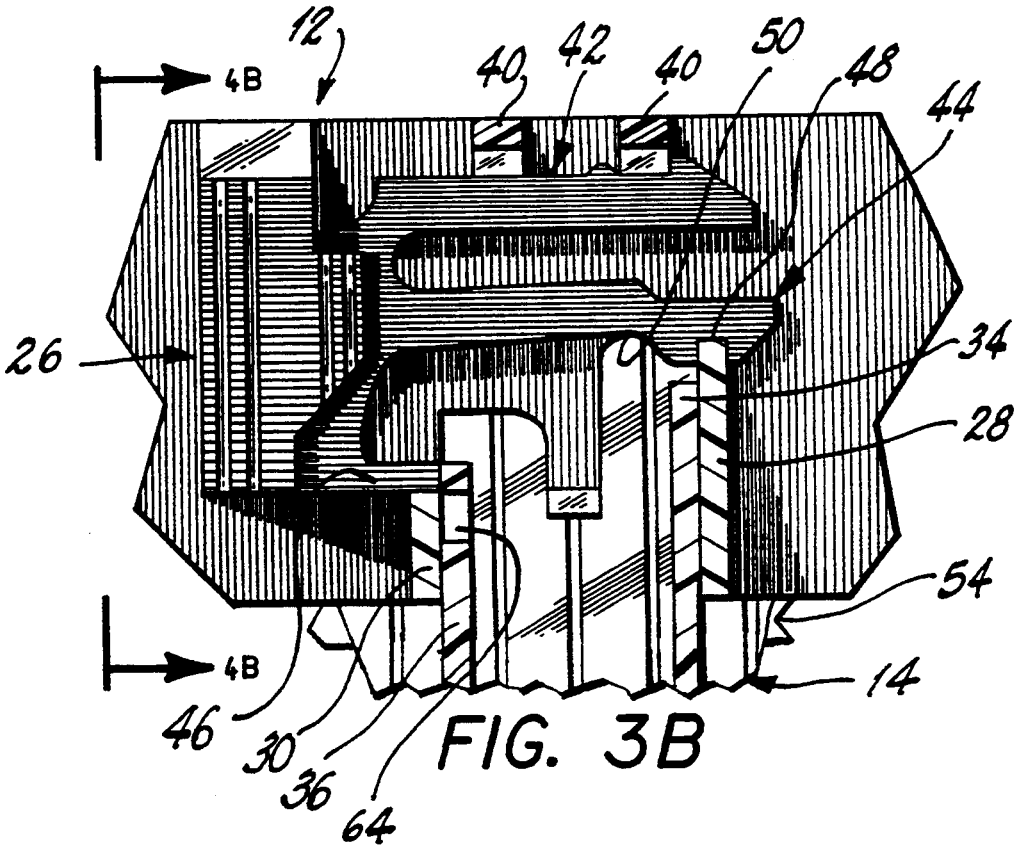
Figure 4A:
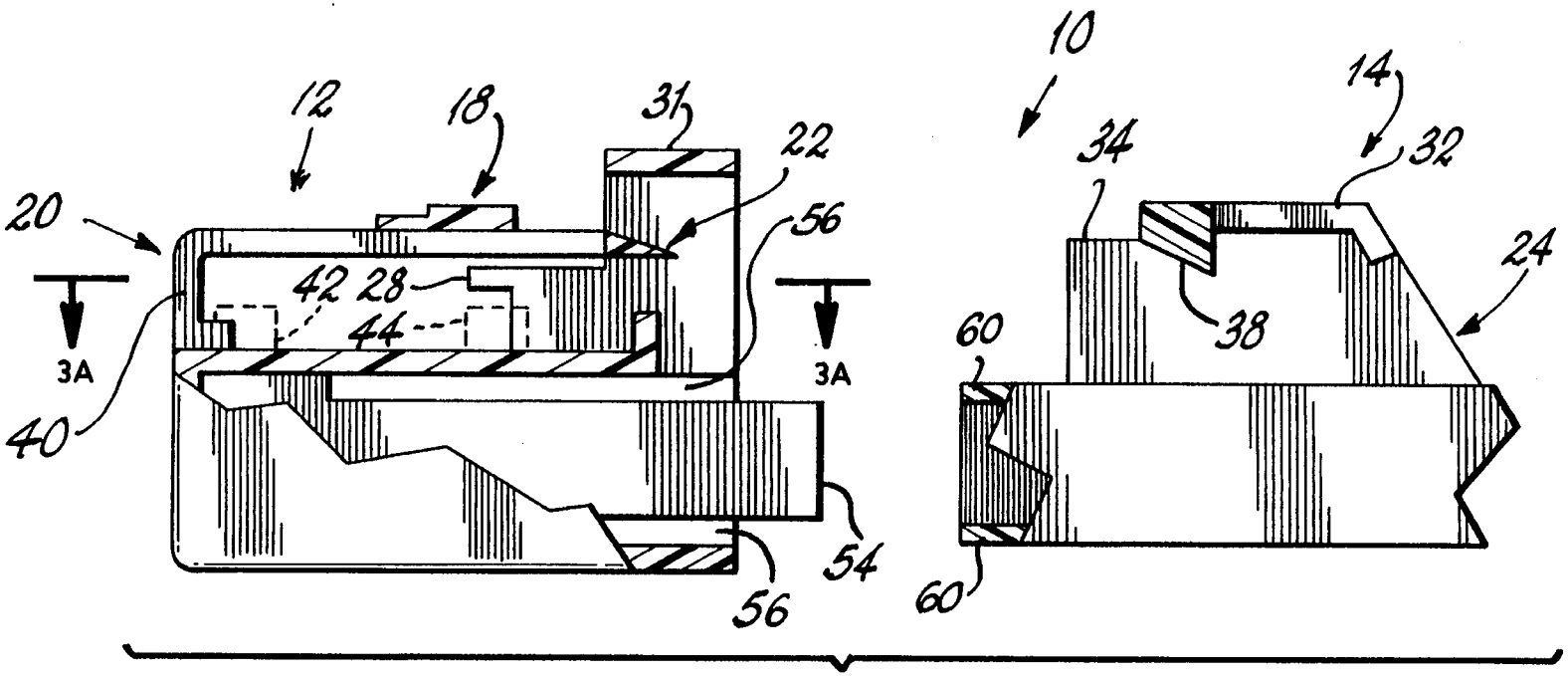
FIGS. 4A–4C are elevational sectional views corresponding to FIGS. 3A–3C.
Figure 4B:
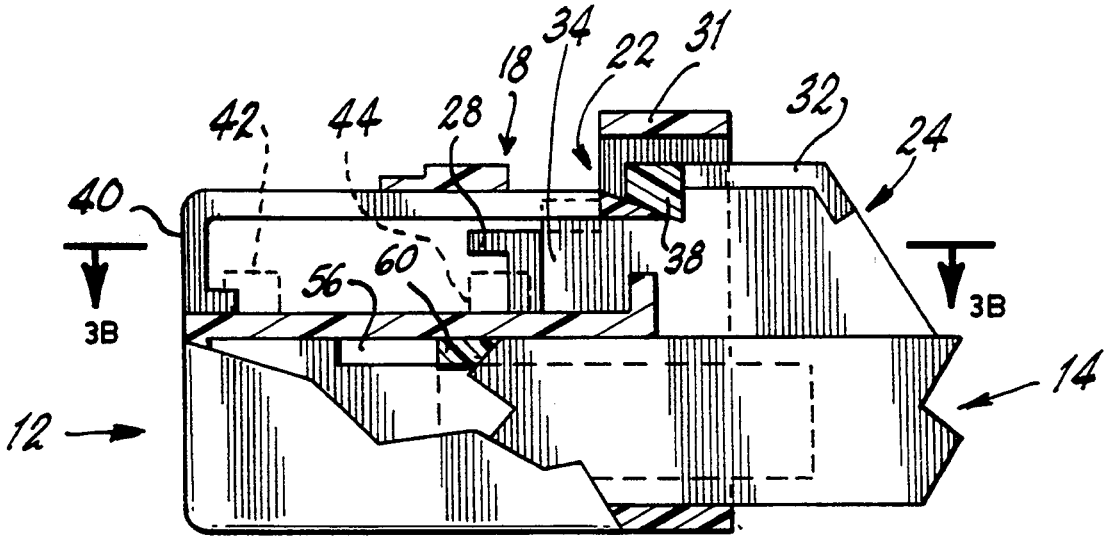

FIGS. 3B and 4B illustrate a partial completion of the mating of the first and second portions. Lip 60 has entered aperture 56 and free end 22 of locking tongue 18 is coming into contact with lug 38 of keeper 24 and, by virtue of the complimentary inclined planes, will slide under the lug 38 upon further penetration of the first and second portions.

Figure 3C:
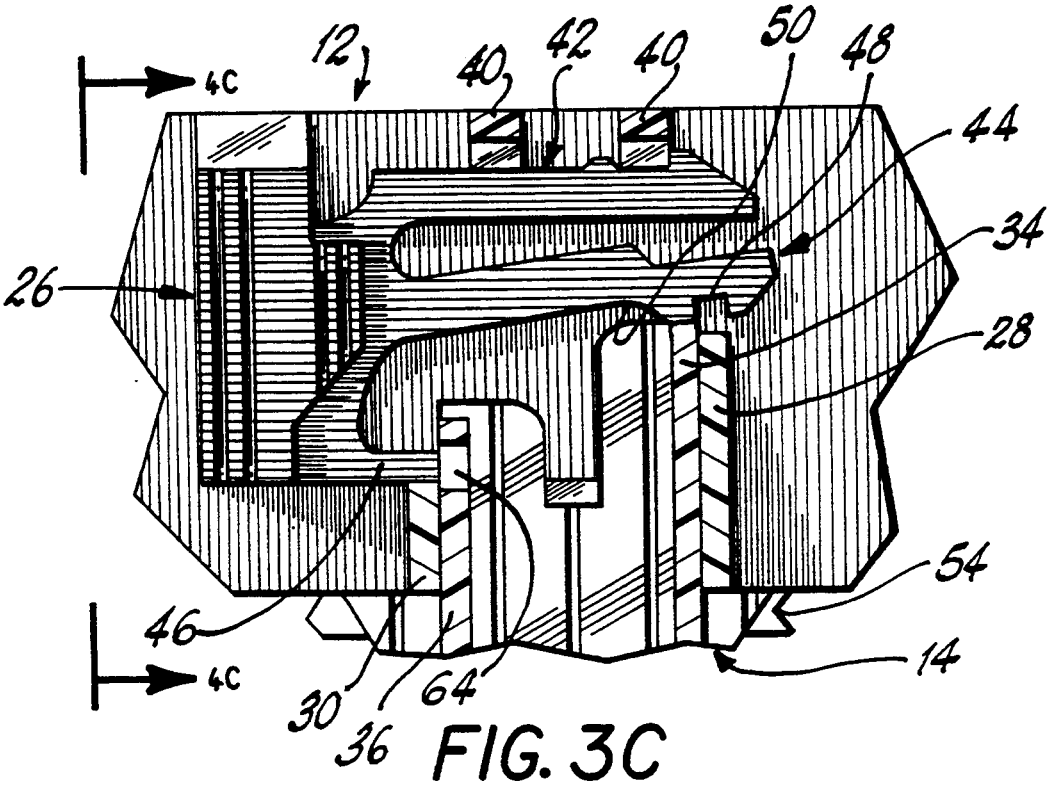
Figure 4C:
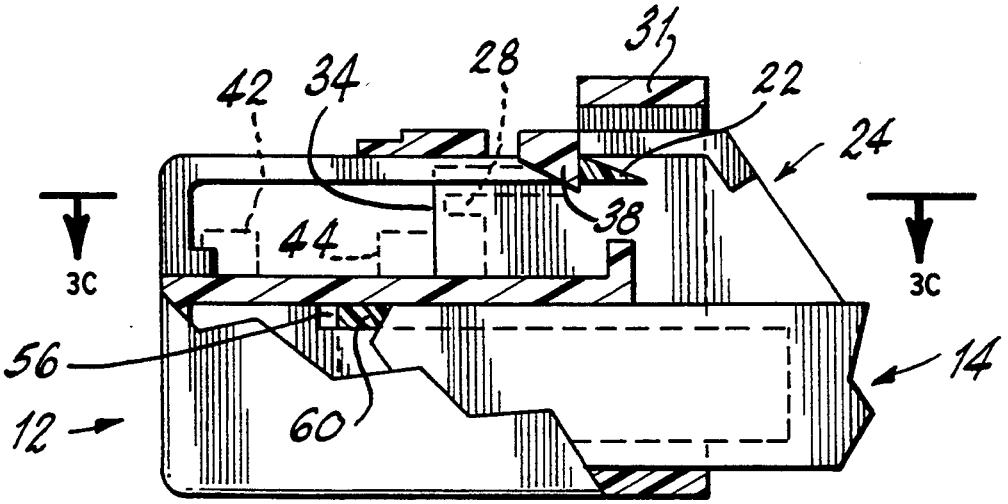

FIGS. 3C and 4C illustrate the first and second portion in their fully mated position. Keeper wall 34 has engaged secondary leg 44 and disengaged it from wall 28 and window 64 in keeper wall 36 is aligned with locking tongue disabler extension 46. When this position is achieved, lock disabler 26 is moved to its second position, as shown in FIG. 5, thus putting extension 46 under the free end of the locking tongue, disabling it by preventing it from moving downward to disengage from keeper 38.

Both the engagement of the free end 22 with keeper lug 38 and the movement of lock disabler 26 from its first position to its second position are accompanied by an audible click and a tactile sensation as the pieces snap into position. The tactile sensation is provided by the cessation of further movement of the pieces. These features inform the operator of the completion of each task.

While it is possible for the portions to be separated, as by physically squeezing secondary leg 44 away from keeper leg 34 and moving the lock disabler 26 in the opposite direction, it is virtually impossible for this action to happen accidently. The locking system thus provided by this invention obviates the disadvantages of the prior art.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A connector comprising: first and second slidably engaging portions; a lock distributed between said first and second slidably engaging portions, said lock comprising: a locking tongue having a fixed end attached to said first portion, and a free end extending therefrom, said fixed end of said locking tongue including at least one upstanding leg; first and second spaced apart side walls positioned adjacent said free end; and a keeper on said second portion, said keeper having a roof and first and second spaced apart side walls, and a depending lug on the interior of said keeper roof, said free end being formed to engage said lug on said keeper roof; and a lock disabler having two operative positions with respect to said locking tongue, a first position allowing disengagement of said free end of said locking tongue from said keeper and a second position preventing disengagement of said free end of said locking tongue from said keeper, said lock disabler including primary and secondary legs and a locking tongue disabler and, in said first position, said primary leg engages said upstanding leg, said secondary leg has a first area which engages said first wall and said locking tongue disabler is in guiding relation with said second wall.

2. The connector of claim 1 wherein said lock disabler has a second area formed with said secondary leg and in said second position said second area being in engagement with said first wall of said keeper, and said locking tongue engager being positioned beneath said locking tongue whereby said locking tongue cannot be disengaged from said keeper.

* * * * *